US008209779B2

(12) United States Patent
Herman

(10) Patent No.: US 8,209,779 B2
(45) Date of Patent: Jul. 3, 2012

(54) UNDERGARMENT SUSPENDERS

(76) Inventor: Sal Herman, Bloomfield Hills, MI (US)

( * ) Notice: Subject to any disclaimer, the term of this patent is extended or adjusted under 35 U.S.C. 154(b) by 23 days.

(21) Appl. No.: 12/872,014

(22) Filed: Aug. 31, 2010

(65) Prior Publication Data

US 2012/0047632 A1 Mar. 1, 2012

(51) Int. Cl.
*A41F 19/00* (2006.01)

(52) U.S. Cl. ..... 2/327; 2/326

(58) Field of Classification Search ..... 2/326, 327, 2/304, 305, 307, 308, 310–312, 338, 336, 2/321, 322

See application file for complete search history.

(56) References Cited

U.S. PATENT DOCUMENTS

| | | | | | |
|---|---|---|---|---|---|
| 1,392,935 | A | * | 10/1921 | Glickman | 2/326 |
| 2,440,982 | A | * | 5/1948 | Speller et al. | 2/305 |
| 3,480,275 | A | * | 11/1969 | Glass et al. | 273/453 |
| 3,501,774 | A | * | 3/1970 | Norman | 2/321 |
| 4,213,548 | A | * | 7/1980 | Wood | 224/168 |
| 4,481,682 | A | * | 11/1984 | Hall | 2/326 |
| 5,497,923 | A | * | 3/1996 | Pearson et al. | 224/639 |
| 5,560,046 | A | * | 10/1996 | Iwamasa et al. | 2/328 |
| 6,125,475 | A | * | 10/2000 | Taylor | 2/333 |

* cited by examiner

*Primary Examiner* — Gloria Hale
(74) *Attorney, Agent, or Firm* — John A. Artz; Dickinson Wright PLLC

(57) ABSTRACT

Suspenders particularly for wearing under outer garments. At least one side of the strap members has loop members thereon which mate with pieces of hook-type material secured adjacent the ends of the strap members. Adjustment buckles are eliminated.

4 Claims, 3 Drawing Sheets

UNDERGARMENT SUSPENDERS

TECHNICAL FIELD

The present invention relates to suspenders and more particularly to suspenders designed to be worn under clothing.

BACKGROUND

Suspenders used to support pants or trousers on a person's body are in common use today. There are many types of known suspenders and they typically include a pair of straps which fit over the shoulders of the wearer and ends which attach to the waistband of the pants. The suspenders have a pair of straps extending vertically along the front torso of the wearer for attachment to the front of the pants, and at least one strap on the back of the wearer which also is adapted to be connected to the pants.

The ends of the straps of the suspenders are attached to the pants in a number of ways. The straps typically are attached to the pants with buttons or clips. As to button attachments, the buttons are sewn on the pants near the waistline, and the ends of the straps have button holes or attachments with button holes. As to clips, various types of clips are in use today such as those found in U.S. Design Pat. Nos. D614,946 and D619,495.

Most of the suspenders also have buckles near the ends of the straps in order to adjust the length of the straps. The ends of the straps, typically the front straps but also sometimes on the rear straps as well, are slipped through openings in the clips and extended back along the straps to the adjustment buckles.

Suspenders are primarily designed to be worn over or outside a shirt, with the shirt being tucked into the pants. If the suspenders are covered with clothing, it is typically a suit coat, sport coat or another type of coat or jacket.

Today, however, numerous persons prefer to wear their shirts on the outside of their pants. This often creates a difficult or awkward situation if the wearers have suspenders under the shirts in the event that the wearers need to use the restroom facilities. Also, particularly if the shirt is form fitted, the buckles on the straps which are used to adjust the length of the straps cause unsightly bulges or bumps on the wearer's torso.

SUMMARY OF THE INVENTION

An improved suspender is provided which allows use under outer garments. The suspender allows infinite adjustability of the straps and does not include buckles or other objects on the straps which could cause visible bulges or bumps.

In one embodiment, a pair of straps are provided with fasteners at each end, particularly clip-type fasteners. The pair of straps are connected together preferably at a location on the back of the wearer when they are worn. The fasteners are connected to ring members which allow the ends of the straps to slide easily through them.

At one end of the two straps (at the back of the wearer), the ends are passed through the ring members and securely attached or connected to the straps. This can be done by sewing. At the other ends of the two straps (at the front of the wearer), the ends are passed loosely through the ring members. These ends also have pieces of fastener material attached with a series of small hooks on it. The fastener materials are preferably pieces of hook-type Velcro material and are glued or otherwise securely affixed to the ends of the two front straps.

The material for the straps is provided on one side with a plurality of small loops along the surface. In this manner, the ends of the straps with the pieces of hook-type material on it can be positioned and secured anywhere on the strap. This provides significant benefits as to the ease of adjusting and releasing the suspender straps, as well as the elimination of buckles, bulges and bumps which show on outer garments when the suspenders are worn under them.

The opposite side of the strap material (i.e. the outside) preferably has a smoother or harder surface. This allows outer garments to slide freely over the straps without sticking or being hung-up.

The material for the straps also can be stretchable, which would further assist in the adjustability of the suspenders, as well as increase the comfort to the wearer.

In another embodiment, the straps have a different configuration. The pair of straps fit over the shoulder of the wearer, but are connected together at the sides of the wearer adjacent the wearer's waist. In this embodiment, only two fasteners are necessary to attach the suspenders to the wearer's pants. The front portions of the two straps have adjustment systems similar to that described above with respect to the first embodiment.

DESCRIPTION OF THE PREFERRED EMBODIMENTS

Figure 1:
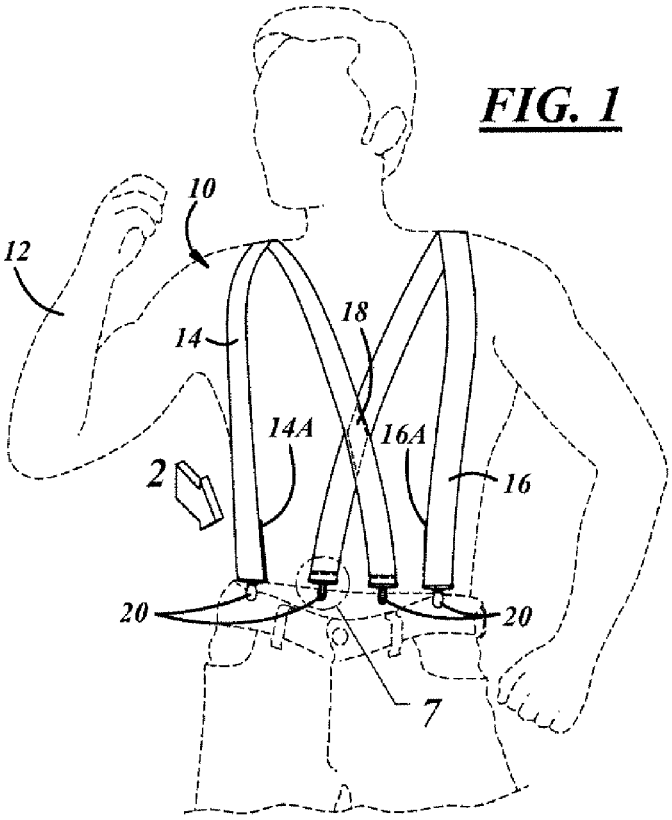
FIG. 1 is a first perspective view of the suspenders as worn by a person.

An embodiment of the inventive suspender 10 is shown in FIG. 1 and is shown in a manner that it would be worn by a person or wearer 12. The suspender 10 includes a pair of strap members 14 and 16 which are attached together where they overlap 18 in a position at the back of a wearer when the suspender is worn.

Figure 2:
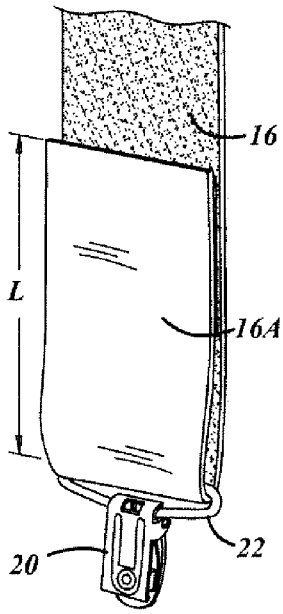
FIG. 2 is an enlarged view of a portion of FIG. 1.
Figure 4:
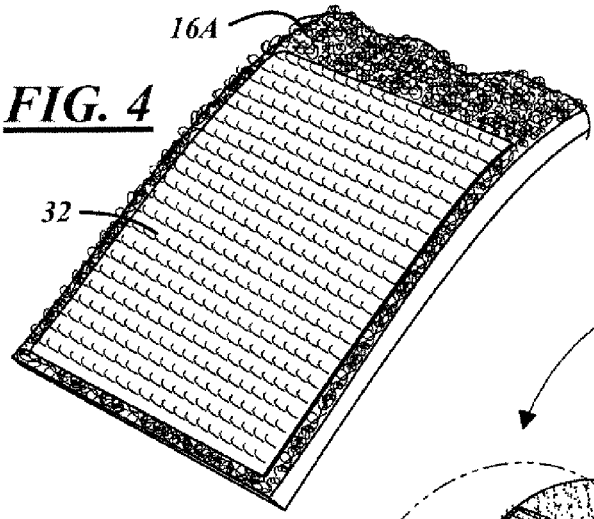
FIG. 4 is an enlarged view depicting the piece of material with hook members.

Each of the strap members have a sufficient length to extend from the waistline at the rear of the wearer to the waistline at the front of the wearer, plus an additional amount which is used to adjust the suspenders for different sizes and shapes of wearers. These additional amounts are indicated by the reference numerals 14A and 16A in the drawings, as well as by "L" in FIG. 2.

The strap members 14 and 16 are attached together at 18 where they overlap. They can be connected together by any mechanism or method which securely affixes them together, such as by being sewn together.

In this regard, it should be understood that the invention is not to be limited to suspenders having the precise structure and configuration as shown in FIG. 1. The invention can be utilized with most all of the various sizes, shapes and strap configurations of suspenders known today, such as those shown, for example, in U.S. Design Pat. No. D243,293. Another embodiment of suspenders which can utilize the present invention is shown in FIG. 8-11 and described below.

Fastener members 20 are used to connect the strap members to the pants or trousers worn by the wearer. Preferably, the fasteners 20 are clip-type fastener members, such as those shown in U.S. Design Pat. Nos. D614,946 and D619,495. However, the invention can be used with any type of conventional fastener members used with suspenders today, including buttons and snaps.

The fastener members 20 as shown have a loop or ring member 22 attached to them. The ring member 22 allows the strap members to slide through them.

Figure 7:
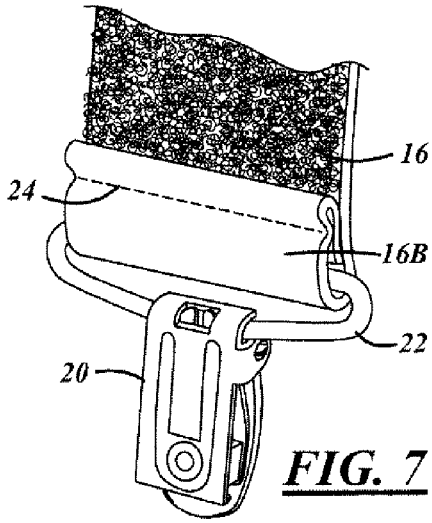
FIG. 7 depicts a fastener affixed to the end of a back strap member.

As to the portion of the suspenders which are to be positioned at the back of the wearer, the fastener members 20 are securely affixed to the ends of the strap members. This is shown, for example, in FIG. 7 where the end 16B of the strap member 16 is positioned through the ring member 22 and securely attached, such as by stitches 24 made by sewing, on the strap member. Preferably, both of the "rear" or "back" ends of the strap members 14 and 16 are connected to their respective fastener members in the same way.

Figure 3:
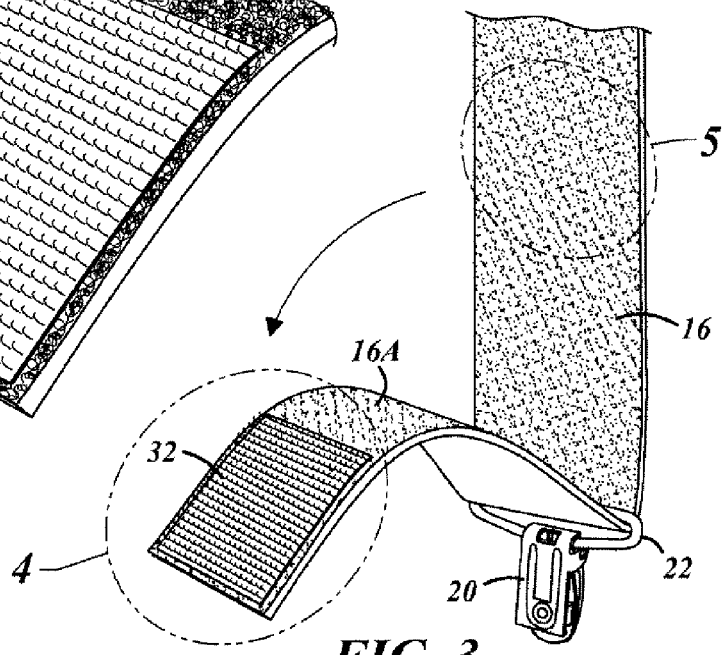
FIG. 3 depicts an unfastened end of a front strap.
Figure 5:
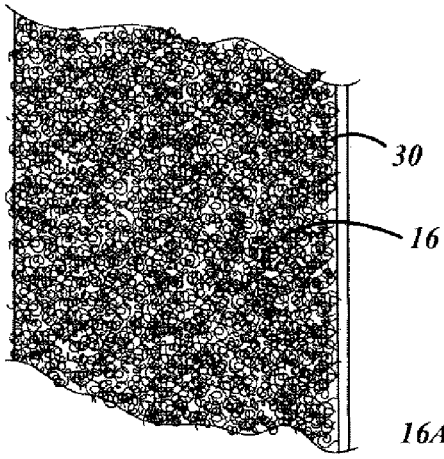
FIG. 5 is an enlarged view depicting the surface of the strap member with loop members.

The portion 16A of the strap member 16 is adapted to be secured at any position along the strap member that the wearer desires. This makes the suspenders essentially infinitely adjustable. For this purpose, the strap members are made of a material with a plurality of small loop members 30 on at least one surface. This is shown in FIGS. 3 and 5. Additionally, a piece of Velcro-type hook material 32 is glued, sewn or otherwise securely affixed to the end portion 16A of the strap member 16. The piece of material 32 has a plurality of small hook members extending therefrom.

Figure 6:
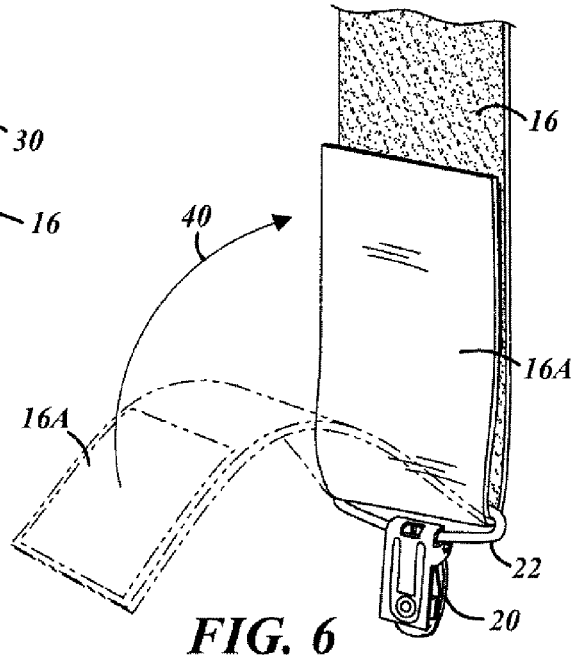
FIG. 6 illustrates the fastening of the end of a front strap member.

When the strap portion 16A is passed through the ring member 22 and pressed up against another portion of the strap member 16, some of the hook members on material 32 mate with some of the loop members 30 and secure the two items together. This movement is shown by arrow 40 in FIG. 6.

Although any type of material with hook members thereon can be used as material 32, preferably the material is one-half of a Velcro-type fastening system.

Since the loop members 30 are present all along one of the surfaces of the strap members 14 and 16, the suspenders in accordance with the present invention are infinitely adjustable. This allows the suspenders to be easily adjusted to fit any body size or shape. It also allows a wearer to quickly and easily adjust the suspenders at any time for any reason, such as to make them more comfortable on certain days. This also allows the wearer to be able to unfasten the suspenders without undoing the front fasteners.

Although the above description relates specifically to strap member 16, it is to be understood that the same structure and members are to be used for strap member 14 and any other strap members in any other suspender configuration incorporating the present invention.

Preferably, the loop members 30 are provided only on one side of the strap members and this is the side which is worn adjacent the body of the person. (This also is what is shown in the drawings.) The other side of the strap members, that is the outer side, preferably has a smoother and harder surface. This allows outer garments to side easily over the strap members without catching or sticking. Of course, it is also possible that the strap members can have the same hook-type surfaces on both sides, or the suspenders could be worn with the hook side out.

The material used for the strap members 14 and 16 also can be stretchable or elastic. This would provide additional comfort and adjustability to the wearer.

Figure 8:
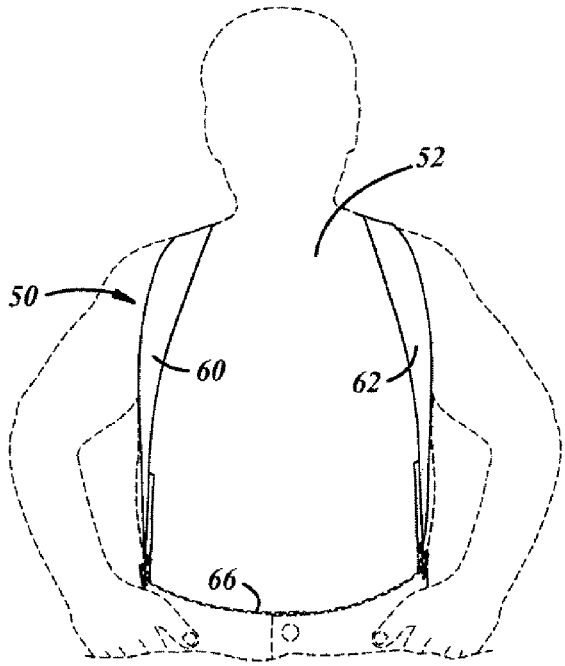
FIGS. 8-11 depict an alternate embodiment of the invention.
Figure 9:
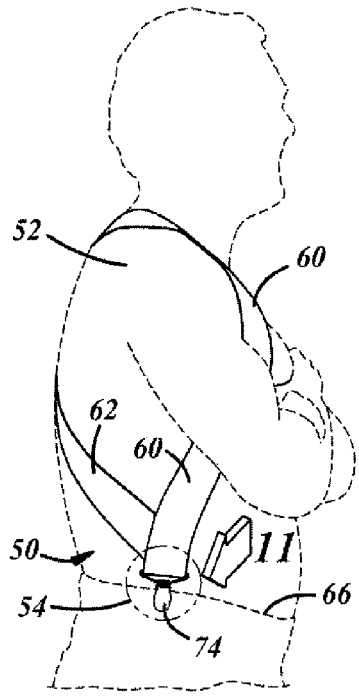
Figure 10:
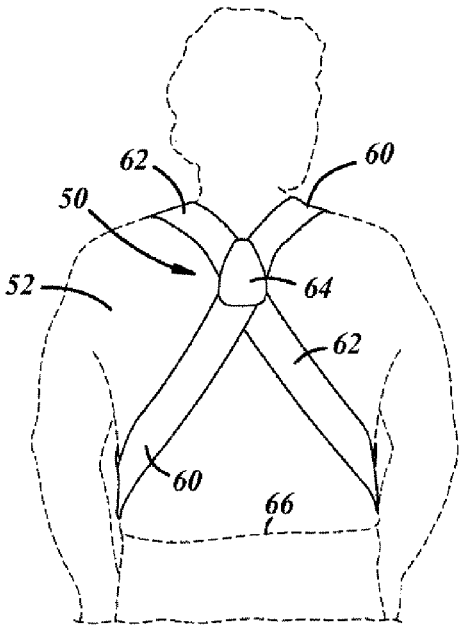
Figure 11:
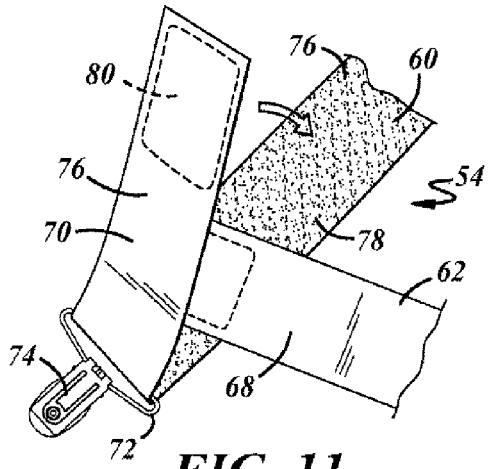

A second embodiment of the present invention is shown in FIGS. 8-11. The strap material, fasteners and adjustment system are preferably the same as those set forth above relative to FIGS. 1-7, although only two fasteners are needed. FIG. 8 depicts the front view of this embodiment 50 as worn by a person 52, while FIG. 9 is a side view and FIG. 10 is a back view. FIG. 11 is an enlarged view of a portion 54 of the figure shown in FIG. 9.

This embodiment is similar to that sold as "Hip-Clip Suspenders" by Hold-Up Suspender Company in Southfield, Mich.

The suspenders 50 have a pair of strap members 60 and 62. The strap members are connected together where they crossover each other 64 on the back or rear of the wearer. The strap members can be connected at 64 in any secure way, such as by sewing.

The strap members 60 and 62 are also attached to each other at a position on the sides of the wearer and adjacent the waistband 66 of the wearer's pants or trousers. This is shown for one side in FIG. 9. The attachment mechanism on the other side of the wearer is the same. The end 68 of strap member 62 is securely attached to strap member 60, while the end portion 70 of strap member 60 is passed through ring member 72 of fastener 74 and releasably attached to itself (at point 76 in FIG. 11). This is the adjustment system or mechanism for the suspenders and is substantially the same as the adjustment mechanism for suspenders 10 as described above.

In this regard, the outer side of surface 76 of the strap member preferably has a hard finish or texture which prevents sticking of any outer garments. The opposite side or surface 78 of the strap member has a plurality of small loop members therein. A piece of hook-type Velcro material 80 is secured to the end portion 70 of the strap member in order to mate with and be releasably fastened to the loop members.

The present invention eliminates the metallic or plastic buckles that are in use today in most suspenders for adjustment of the front straps on the wearers. This eliminates the possibility of unsightly bumps or bulges under the outer garment.

Although the invention has been described with respect to preferred embodiments, it is to be also understood that it is not to be so limited since changes and modifications can be made therein which are within the full scope of this invention as detailed by the following claims.

What is claimed is:

1. Suspenders for wearing over the shoulders of a person and for attachment to the waistband of the person's pants, the suspenders comprising:

a pair of strap members, each strap member having a first end and a second end and a first surface and a second surface;

said first surface of each of said strap members having a plurality of loop members over said entire first surface, and said second surface of each of said strap members being smooth over said entire second surface;

first fastener members adjustably attached to said first ends of one of said pair of strap members;

said adjustably attached fastener members having ring members through which end portions of said first ends freely pass through;

a single hook-type member secured on said first surfaces of each of said strap members at said end portions of said first end of each of said strap members;

said hook-type member having a plurality of hook members thereon;

second fastener members securely attached to the second ends of said pair of strap members;

wherein when said first ends of said strap members are passed through said ring members, and said hook-type members are selectively secured to said loop members at any position along said first surface; and wherein buckles on said strap members for adjustment are not present and said smooth side of said strap members minimize clothes sticking thereto.

2. The suspenders as described in claim 1 wherein said first and second fastener members are clip-type fastener members.

3. The suspenders as described in claim 1 wherein each of said strap members have sufficient length to extend over the shoulder from the front waistband of the person to the rear waistband of the person, including said additional end portions.

4. The suspenders as described in claim 1 wherein said pair of strap members are connected together at the ends adjacent the waistband of the person's pants.

* * * * *